US007568367B2

(12) United States Patent
Huang

(10) Patent No.: US 7,568,367 B2
(45) Date of Patent: Aug. 4, 2009

(54) TWO-WAY OPENED STRAP LOCK WITH AN INDICATION

(76) Inventor: Chien-Yung Huang, No. 189~3, Hann Shen E. Road, Banchiao City, Taipei Hsien (TW)

( * ) Notice: Subject to any disclaimer, the term of this patent is extended or adjusted under 35 U.S.C. 154(b) by 0 days.

(21) Appl. No.: 12/004,713

(22) Filed: Dec. 19, 2007

(65) Prior Publication Data

US 2008/0156045 A1 Jul. 3, 2008

(30) Foreign Application Priority Data

Dec. 29, 2006 (TW) ..... 95223189 U

(51) Int. Cl.
*E05B 73/00* (2006.01)

(52) U.S. Cl. ..... 70/58; 70/284; 70/285; 70/432; 70/DIG. 63

(58) Field of Classification Search ..... 70/21, 70/57, 58, 284, 285, DIG. 63, 432–441
See application file for complete search history.

(56) References Cited

U.S. PATENT DOCUMENTS 6,912,879 B1 * 7/2005 Yu ..... 70/58
7,104,095 B1 * 9/2006 Lin ..... 70/58
7,357,008 B2 * 4/2008 Yu ..... 70/58
7,415,853 B2 * 8/2008 Yu ..... 70/68
7,424,813 B2 * 9/2008 Wu ..... 70/58
2006/0272368 A1 * 12/2006 Yu ..... 70/58
2007/0175247 A1 * 8/2007 Yu ..... 70/58
2007/0214853 A1 * 9/2007 Huang ..... 70/432
2008/0016921 A1 * 1/2008 Yu ..... 70/18
2008/0041126 A1 * 2/2008 Yu ..... 70/58
2008/0066503 A1 * 3/2008 Su ..... 70/58

* cited by examiner

*Primary Examiner*—Lloyd A Gall
(74) *Attorney, Agent, or Firm*—Pro-Techtor Int'l Services; Ralph Willgohs

(57) ABSTRACT

A two-way opened strap lock with an indication is a strap lock having a housing and a cover. A mouth at an end of the housing provides for an insertion and locking of push buttons of the cover, an interior of the housing is provided with dials, a tumbler, and an indicator assembly, and the indicator assembly includes a switch and an indicator. By using a key to drive the tumbler to rotate, the indicator can be driven to displace from a first position to a second position, of the housing.

3 Claims, 10 Drawing Sheets

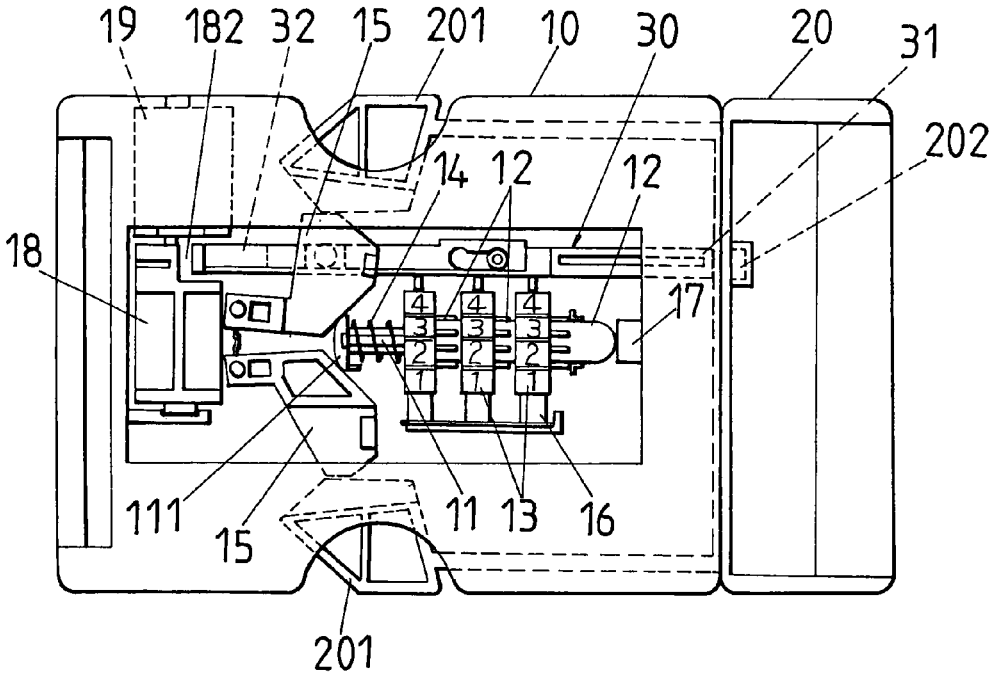
FIG.4
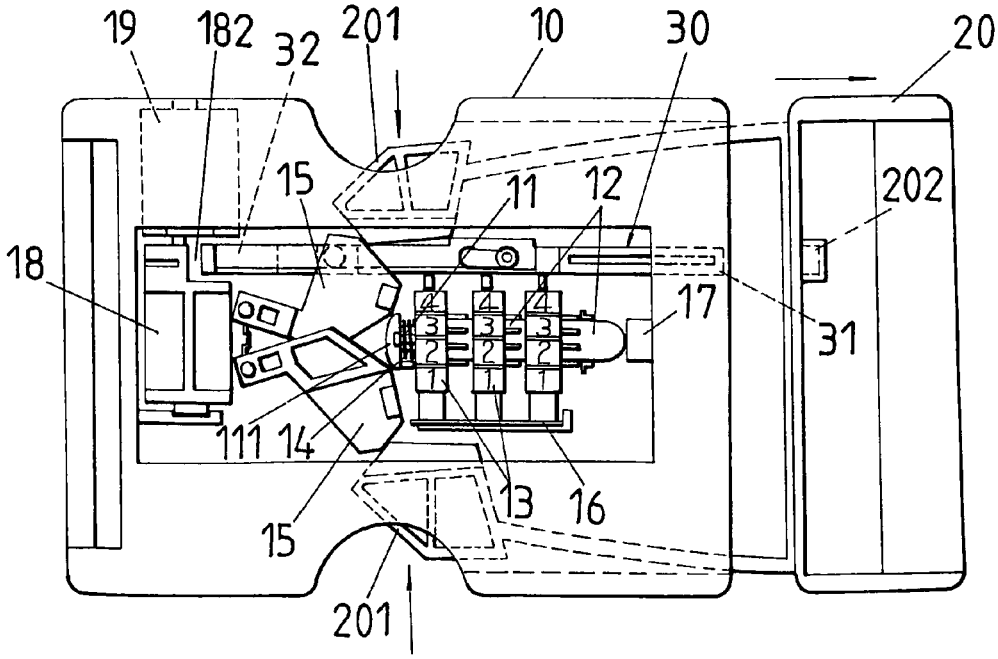
FIG.4~1

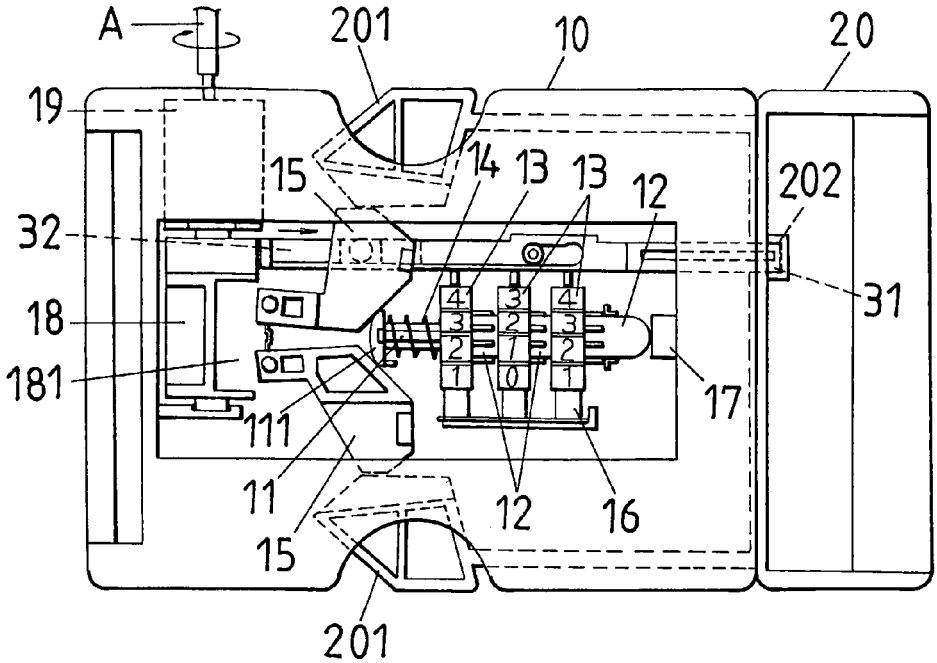
FIG.5
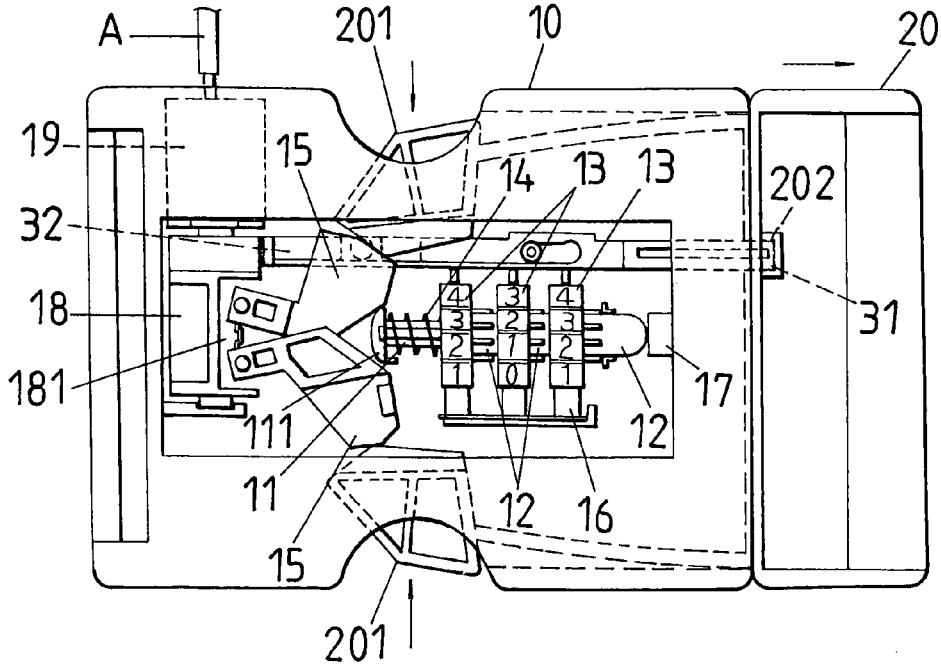
FIG.5~1

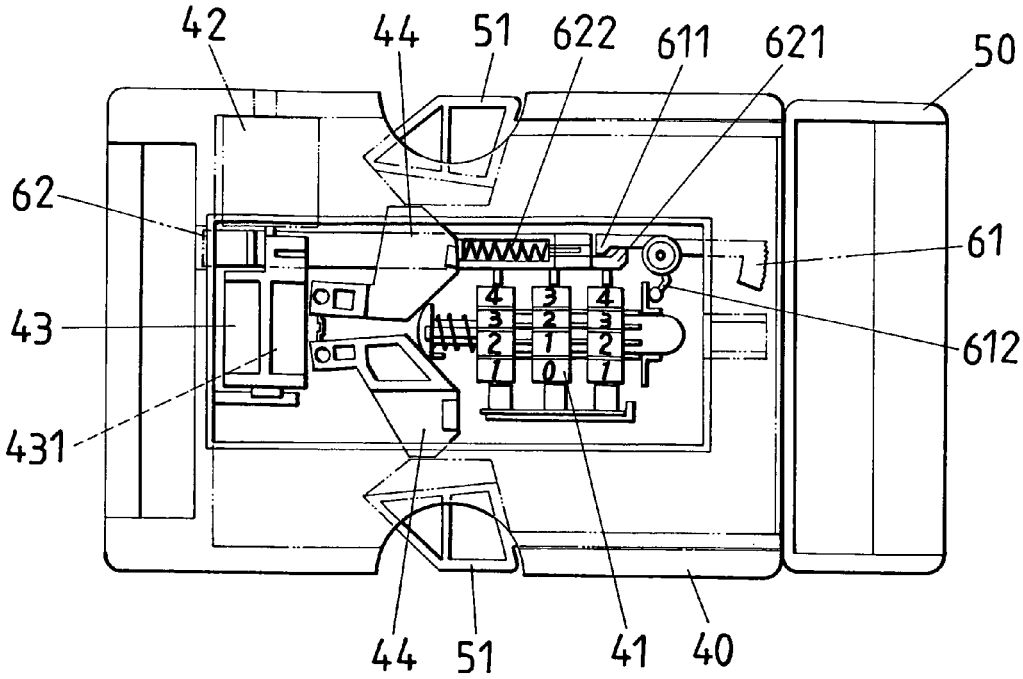
FIG.9
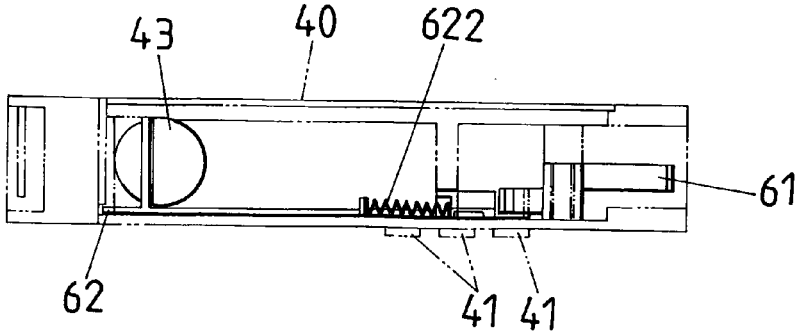
FIG.9~1

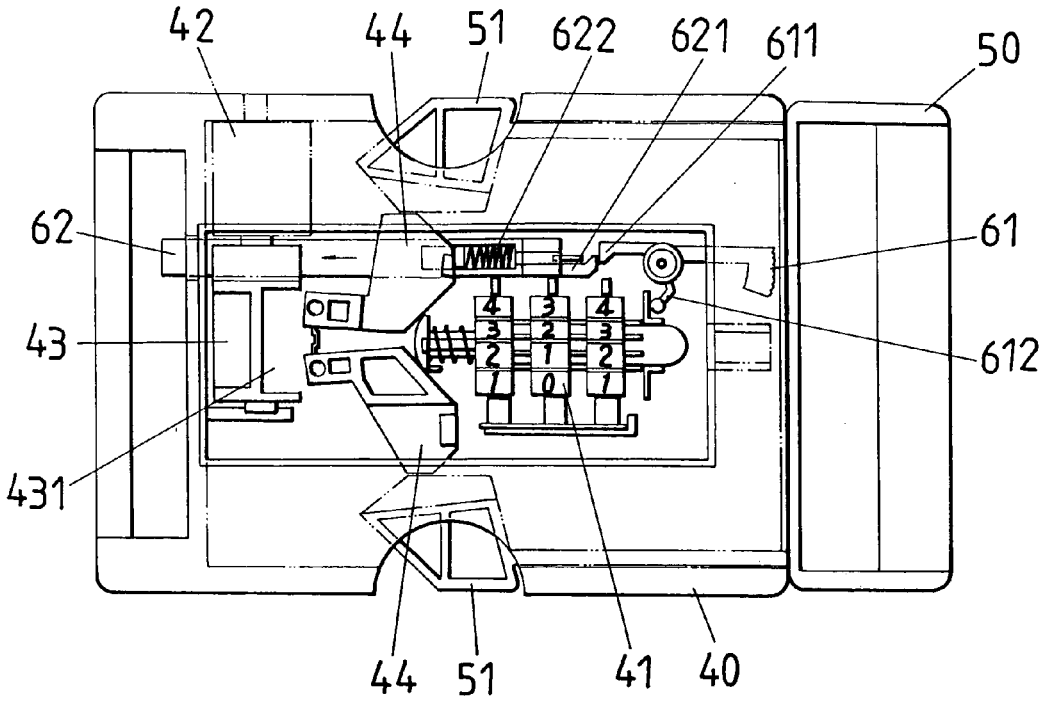
FIG.10
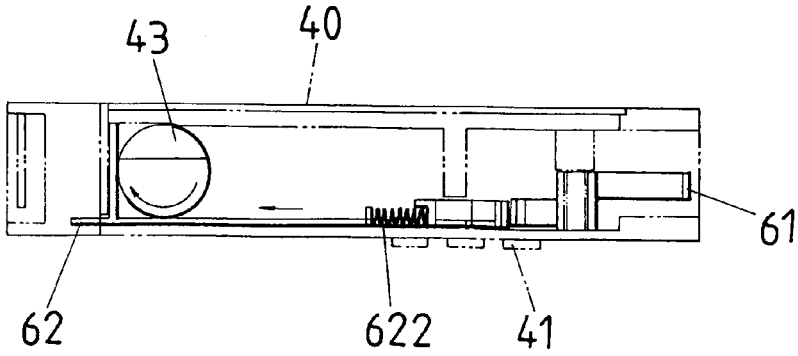
FIG.10~1

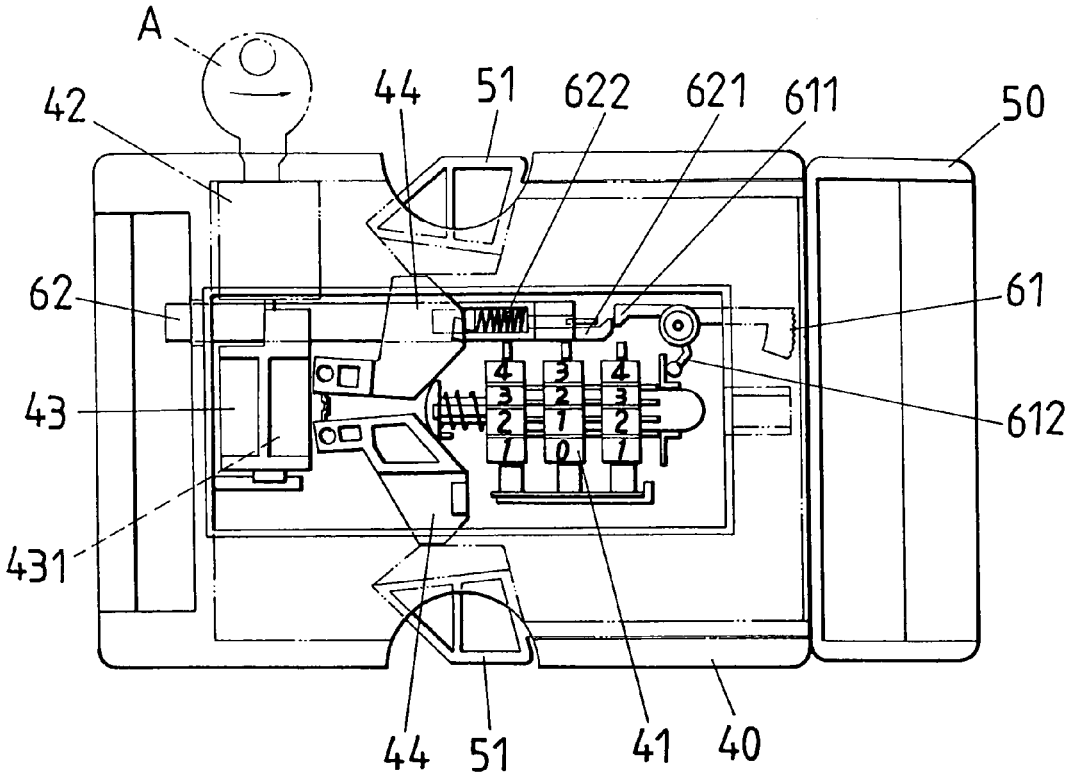
FIG.11
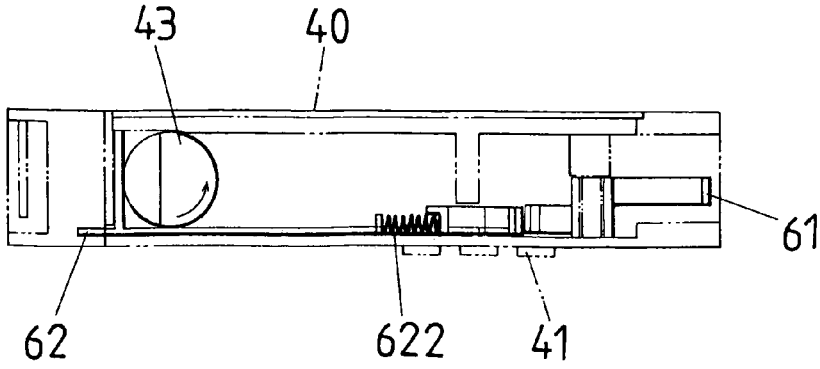
FIG.11~1

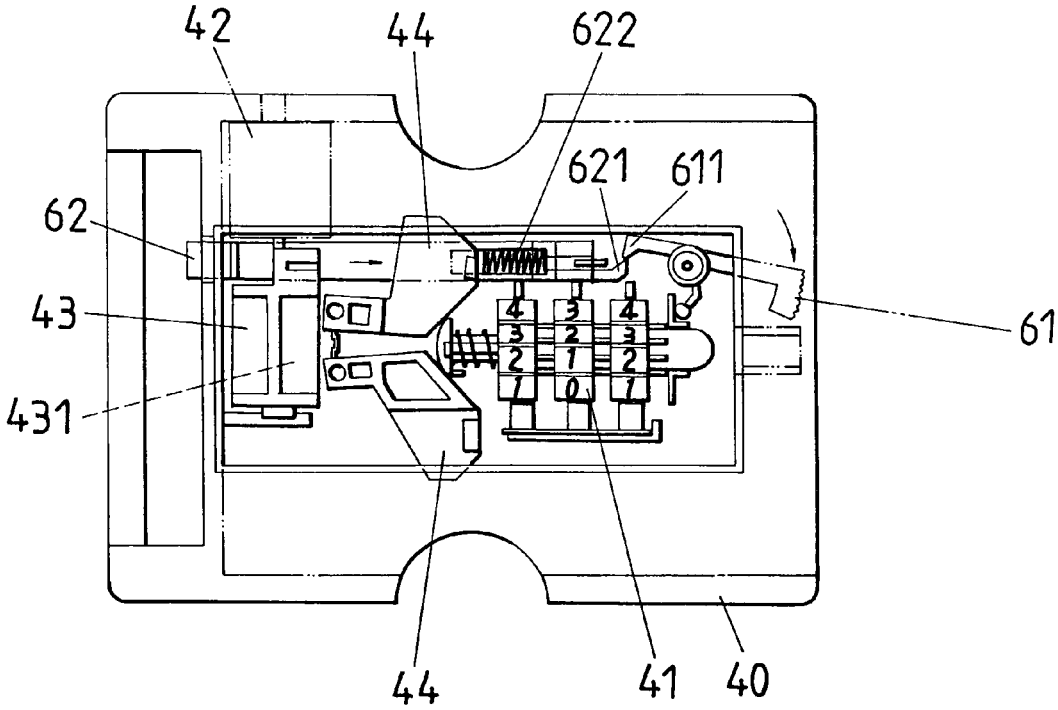
FIG.12
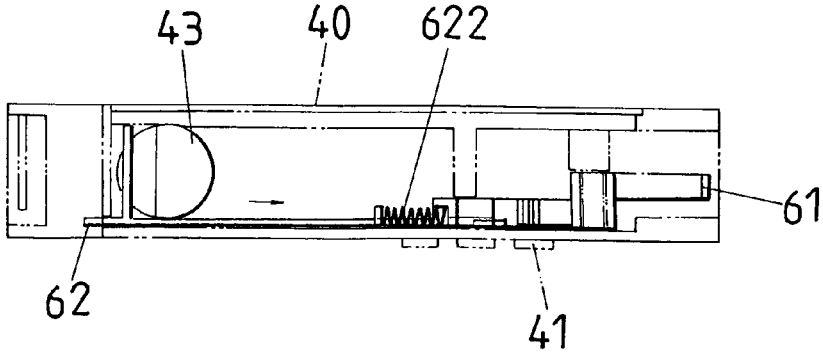
FIG.12~1

TWO-WAY OPENED STRAP LOCK WITH AN INDICATION

BACKGROUND OF THE INVENTION a) Field of the Invention

The present invention relates to a two-way opened strap lock with an indication, and more particularly to a strap lock, which can be opened or closed with dials or a key, and a housing of which is also provided with an indicator assembly to facilitate an inspector to examine contents in a baggage case.

b) Description of the Prior Art

A conventional strap lock only uses a correct combination of numbers on dials to enable opening or closing of the lock, and is not provided with a device to force unlocking, such that an auditor or an inspector has no other way to open the lock to examine or audit. Hence, there is a need for improvement in the prior art.

SUMMARY OF THE INVENTION

The primary object of the present invention is to provide a two-way opened strap lock with an indication, wherein, apart from the strap lock of the present invention enabling dials of a housing to open and close the lock, a key can also be used to rotate a tumbler to enable a force opening of the lock when the dials are in a locked position. When a user uses the dials to open or close the lock, an indicator of a housing indicator assembly will be green or indented. On the other hand, when the dials are locked, if an inspector uses the key to unlock for examining contents in a baggage case, the indicator on the housing will turn red or be protruded. Therefore, when the user sees that the indicator turns red or is protruded, he or she will know that the lock has already been opened and the baggage case has been examined by the inspector, hence the user can turn the dials to open the lock again, to check whether the contents in the baggage case are correct, and then to switch the indicator back to green or to be indented, followed by locking the lock for a next examination.

To enable a further understanding of the said objectives and the technological methods of the invention herein, the brief description of the drawings below is followed by the detailed description of the preferred embodiments.

BRIEF DESCRIPTION OF THE DRAWINGS

FIG. 4 is a rear sectional view of the present invention when in an unlocking position.

FIG. 4-1 is a rear sectional view of the present invention in FIG. 4.

FIG. 5 is a rear sectional view of the present invention when in a locking position, and with the lock opened by a key.

FIG. 5-1 is a rear sectional view of the present invention in FIG. 5.

FIG. 9 is a cutaway view of closing a lock, according to an embodiment of the present invention.

FIG. 9-1 is a top sectional view of the present invention in FIG. 9 (not including a cover).

FIG. 10 is a cutaway view of using a key to open a lock, according to an embodiment of the present invention.

FIG. 10-1 is a top sectional view of the present invention in FIG. 10 (not including a cover).

FIG. 11 is a cutaway view of using a key to close a lock, according to an embodiment of the present invention.

FIG. 11-1 is a top sectional view of the present invention in FIG. 11 (not including a cover).

FIG. 12 is a cutaway view of an embodiment of the present invention, at a moment when an indicator is restored from a second position to a first position by pressing push buttons, after opening a lock by dials and taking out a cover.

FIG. 12-1 is a top sectional view of the present invention in FIG. 12.

DETAILED DESCRIPTION OF THE PREFERRED EMBODIMENTS

Figure 1:
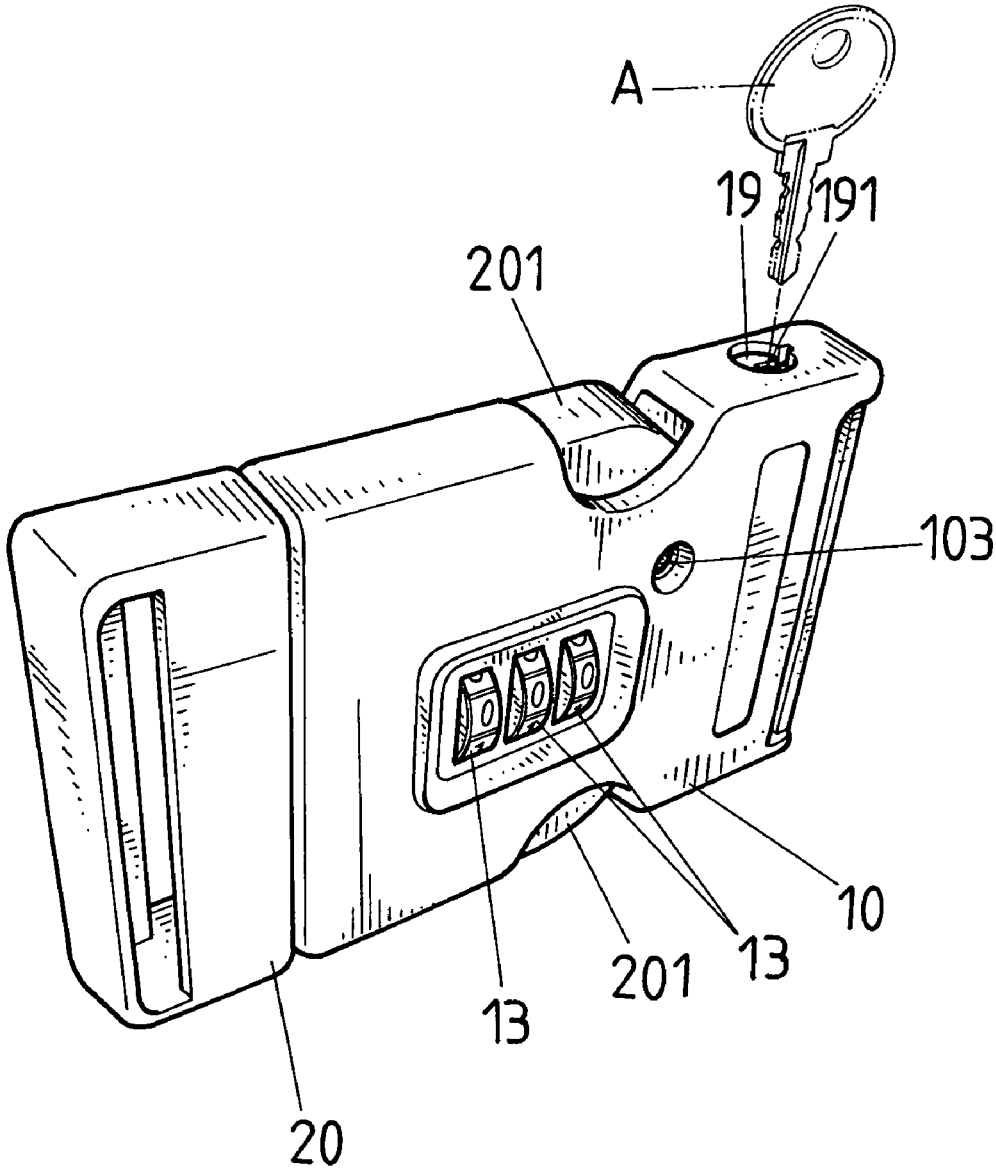
FIG. 1 is a perspective view of the present invention.
Figure 2:
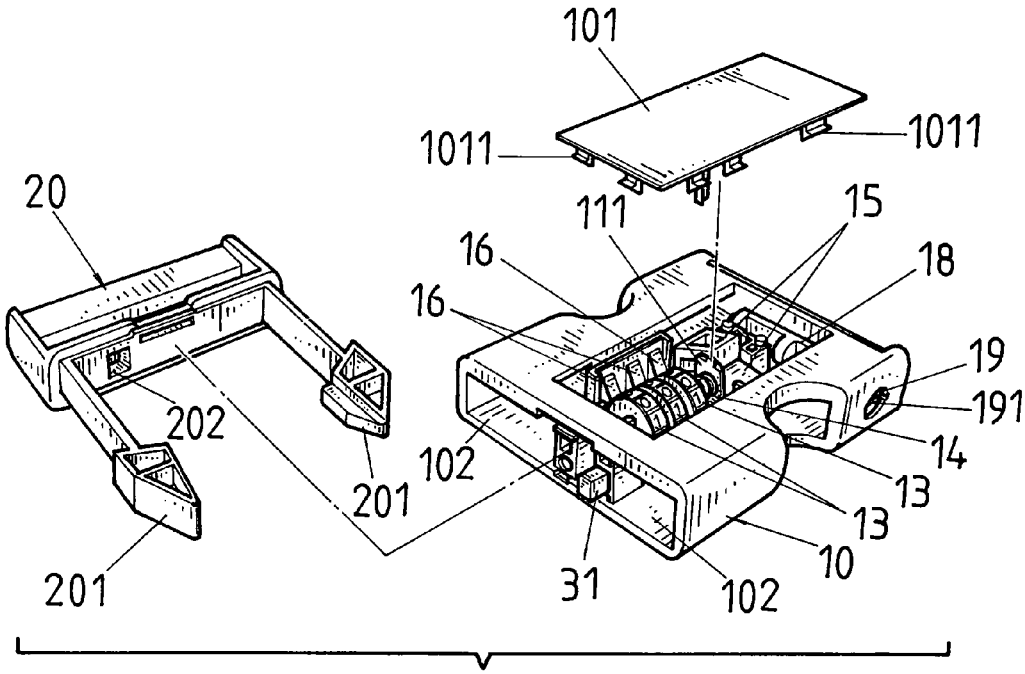
FIG. 2 is an exploded perspective view the present invention.
Figure 3:
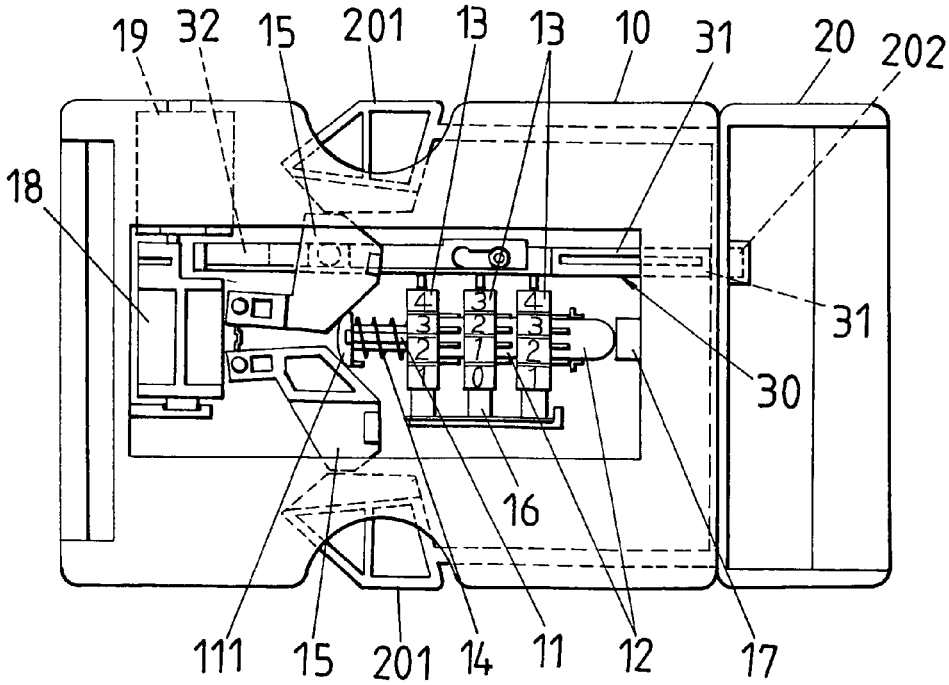
FIG. 3 is a rear sectional view the present invention when in a locking position.

Referring to FIGS. 1 to 3, the present invention comprises a housing 10 and a cover 20, in association with a strap (not shown in the drawings), wherein a bottom cap 101 at a bottom of the housing 10 is locked on the housing 10 by inverted hooks 1011 at peripheries of the bottom cap 101, after internal parts have been assembled. The cover 20 is provided with protruded members or push buttons 201, a side of the housing 10 is provided with a mouth 102, and the other side is provided with an indication hole 103. Once the cover 20 is inserted into the mouth 102 of the housing 10, the mouth 102 will be sealed.

The internal parts of the housing 10 include a shaft 11, three sleeves 12, three dials 13, a spring 14, clamps 15, spring leaves 16, a number-changing button 17, a knob 18, and a tumbler 19, wherein the shaft 11 passes through the spring 14 and the three sleeves 12, and is then abutted at the number-changing button 17, a push block 111 at the other end of the shaft 11 is abutted between the clamps 15, exterior sides of the sleeves 12 are sheathed with the dials 13, with outer rims of the dials 13 being exposed out of the housing 10 (as shown in FIG. 1), whereas inner rims of the dials 13 being abutted at the spring leaves 16.

An interior of the housing 10 is provided with an indicator assembly 30 which includes a switch 31 and an indicator 32 which can be pushed from a first position to a second position, of the housing 10, by the tumbler 19.

Inside the housing 10, and at an end adjacent to the clamps 15 is provided with the knob 18, an end of the knob 18 is connected with the tumbler 19, an exterior side of the tumbler 19 is provided with a lock-core hole 191 for inserting with a key A, and a U-shape slot 181 (as shown in FIG. 5) at an end of the knob 18 provides for emplacing the clamps 15. Moreover, the indicator 32 which is transversally emplaced inside the housing 10 is connected with the switch 31, and an end of the cover 20 is provided with a bearing hole 202, such that when the switch 31 is protruded (or the indicator 32 is at the second position), an end of the switch 31 can be extended out of the housing 10 to be emplaced in the bearing hole 202 of the cover 20, and when the switch 31 is pressed to be indented (or the indicator 32 is switched back to the first position), the switch 32 cannot be switched to the protruded position from the mouth 102 of the housing 10, and an end of the indicator 32 can be extended into a notch 182 (as shown in FIG. 4) of the knob 18. The indicator 32 is provided with at least one color, wherein the colored indicator 32 can be manifested in the indication hole 103 of the housing 10 (as shown in FIG. 1). From the color on the indicator 32, one can know that the indicator 32 is at the first or second position of the housing 10.

Referring to FIG. 3, the dials 13 are in a locked state and the shaft 11 is locked without being able to displace. When a user presses the push buttons 201 at the two ends of the cover 20 of the housing 10, he or she cannot compress the two clamps 15 to squeeze the push block 111 at one end of the shaft 11, the switch 31 inside the housing 10 will not be protruded, and the first position of the indicator 32 manifested at the indication hole 103 will be green.

Referring to FIG. 4 and FIG. 4-1, the dials 13 are in an unlocked state and the shaft 11 is not locked, hence can displace. When the push buttons 201 at the two ends of the cover 20 of the housing 10 are pressed, as shown by the arrows, the two clamps 15 will compress the push block 111 at one end of the shaft 11 inward, to drive the shaft 11 to displace, and then the cover 20 can be separated with the housing 10; whereas, the indicator 32 at the indication hole 103 of the housing 10 will be still green.

Referring to FIG. 5 and FIG. 5-1, the dials are in the locked state, and an inspector inserts the key A into the lock-core hole 191 of the tumbler 19, to turn the tumbler 19 which drives the knob 18 to rotate. The U-shape slot 181 at one end of the knob 18 will face toward the clamps 15, and the other end of the notch 182 will push the indicator 32 to drive the switch 31 to protrude out of the housing 10, enabling the switch 31 to be extended into the bearing hole 202 of the cover 20; whereas, the second position of the indicator 32 at the indication hole 103 of the housing 10 will be red. When the inspector presses the push buttons 201 at the two ends of the cover 20 of the housing 10, as shown by the arrows, he or she can compress the two clamps 15 to displace toward the U-shape slot 181, and the cover 20 can be separated with the housing 10, enabling the inspector to unlock for examining contents in a baggage case.

Figure 6:
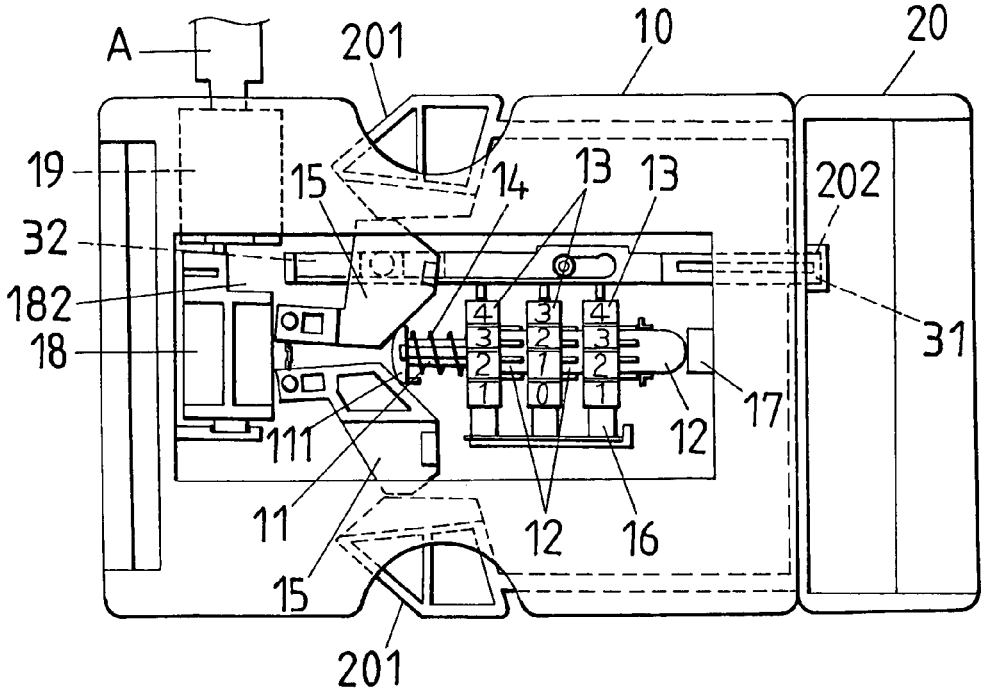
FIG. 6 is a rear sectional view of the present invention when in a locking position, and with the lock closed by a key.

Referring to FIG. 6, after the inspector has examined the contents in the baggage case, he or she locks back the cover 20, turns the key A to drive an end of the knob 18 to abut the clamps 15, and takes the key A off, hence the lock will be in the locked state. At this time, the switch 31 is still extended into the bearing hole 202 of the cover 20, and the indicator 32 (or the second position) at the indication hole 103 of the housing 10 will be still red. After the cover 20 is locked back on the housing 10, the mouth 102 will be sealed, and the switch 31 can not be touched by an ambient object.

Figure 7:
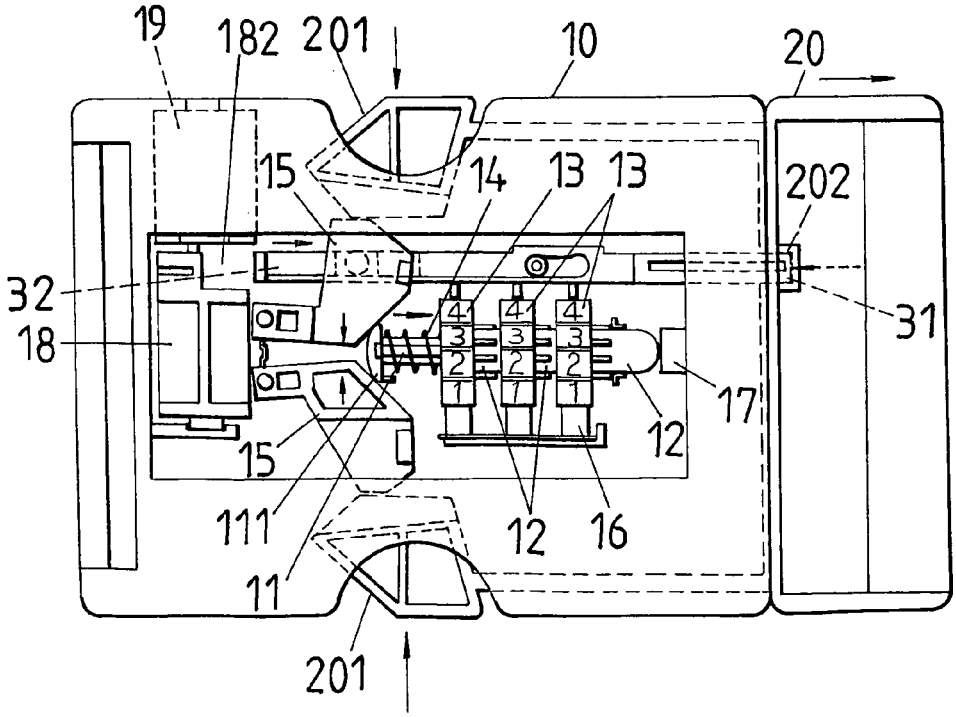
FIG. 7 is a cutaway view of the present invention when in opening a lock by dials, and with a cover being taken out and then a switch being pressed back following indications of arrows.

Referring to FIG. 7, when the user sees the red indicator from the indication hole 103 at a top end of the housing 10, he or she will know that the inspector has unlocked and examined. Therefore, the user will turn the dials 13 to unlock and take down the cover 20 to check whether the contents in the baggage case are correct. After that, the user will push back the switch 31, enabling the indicator 32 at the indication hole 103 of the housing 10 to be green (or the first position). Next, the cover 20 is locked back for a next examination.

Figure 8:
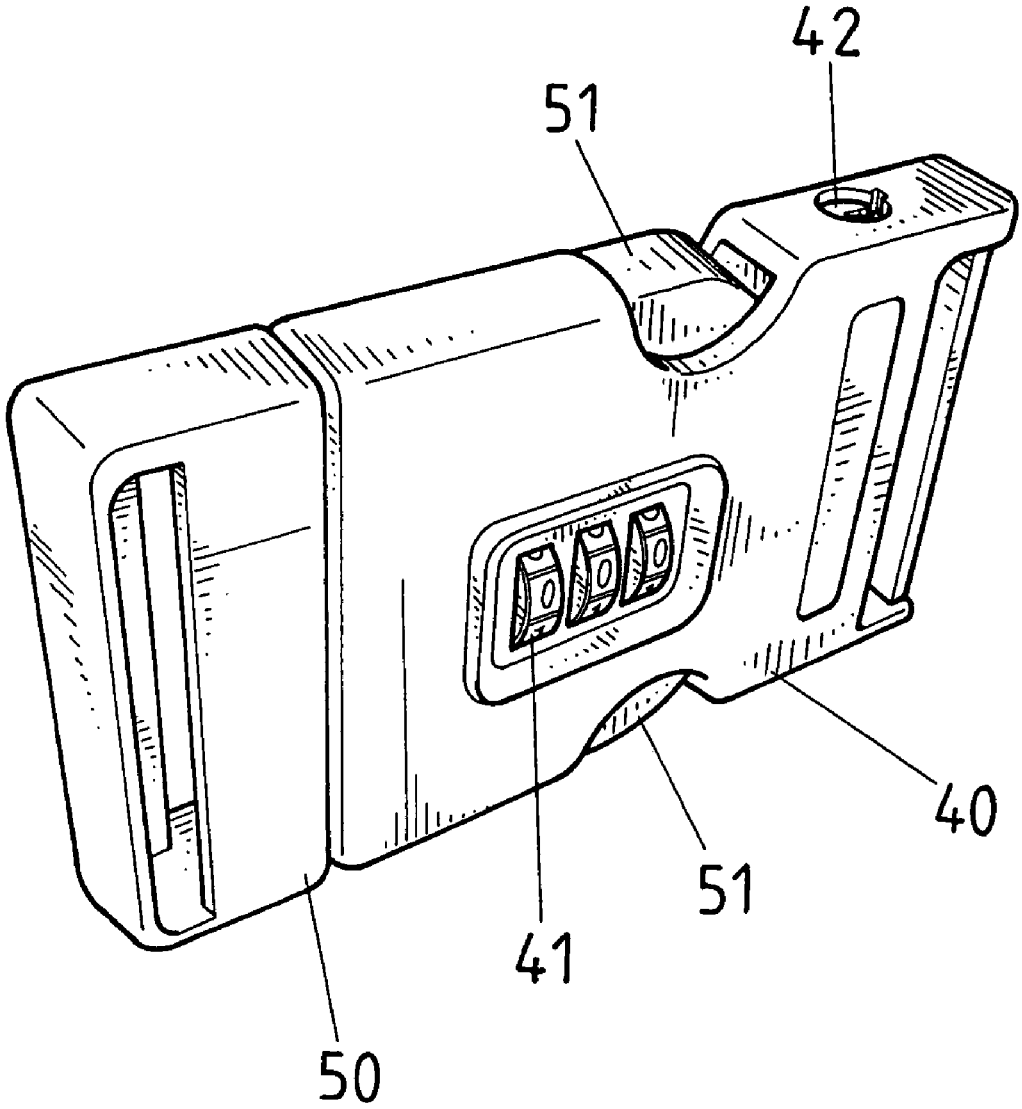
FIG. 8 is a perspective view of an embodiment of the present invention.

Referring to FIG. 8, it shows another preferred embodiment of the present invention, wherein a housing 40 and a cover 50 can be locked together and are connected with a strap (not shown in the drawing). The housing 40 is provided with dials 41 and a tumbler 42, and the cover 50 is provided with protruded members, or push buttons 51.

Referring to FIG. 9 and FIG. 9-1, when the dials 41 are in a locked state, the housing 40 of the present invention is installed with an indicator assembly which includes a switch 61 and an indicator 62, wherein an inverted hook 611 at an end of the switch 61 is latched with an inverted hook 621 of the indicator 62, a center of the indicator assembly is a provided with a spring leaf 612 which is abutted on a stop wall of the housing 10, and a center of the indicator 62 is provided with a spring 622. At this time, the spring 622 is not compressed, and the indicator 62 is at a first position and is not exposed out of the housing 40.

Referring to FIG. 10 and FIG. 10-1, the dials 41 are in a locked state, the inspector inserts the key A into the tumbler 42, and turns the tumbler 42 to drive a knob 43 inside the housing 40 to rotate. A U-shape slot 431 at an end of the knob 43 will face toward clamps 44, and the key A will rotate clockwise by a 90° to push the indicator 62 out of the housing 10, forming a second position and compressing the spring 622 at a same time. The inverted hook 611 of the switch 61 will then be latched with the inverted hook 621 of the indicator 62, and then the inspector can compress the two clamps 44 inward, to separate the cover 50 with the housing 40 for examining the contents in the baggage case.

Referring to FIG. 11 and FIG. 11-1, after the inspector has examined the contents in the baggage case, he or she locks back the cover 50, turns the key A counterclockwise to drive an end of the knob 43 to abut the clamps 44, and takes the key A off, hence the lock will be in the locked state. At this time, the indicator 62 is still protruded out of the housing 40.

Referring to FIG. 12 and FIG. 12-1, when the user sees that the indicator 62 is protruded out of the housing 40, he or she will know that the inspector has unlocked and examined. Therefore, the user will turn the dials 41 to unlock and take down the cover 50 to check whether the contents in the baggage case are correct. After that, the user will push the switch 61, enabling its inverted hook 611 not to be latched with the inverted hook 621 of the indicator 62 again. Then, the spring 622 will push the indicator 62 to the first position of indentation from the second position of protrusion. Accordingly, the locked state in FIG. 9 will be restored again, for awaiting a next examination. Therefore, by the protrusion and indentation of the indicator 62, the user can clearly identify whether the baggage case has been opened by the key.

As is apparent from the foregoing, apart from the strap lock of the present invention enabling the dials of the housing to open and close the lock, a key can also be used to rotate the tumbler to enable force opening of the lock when the dials are in a locked position, to provide an inspector to unlock for examining. The housing can be also provided with an indicator for showing a green color (indented) or a red color (protruded), to confirm whether the inspector has unlocked for examining. Besides, once the inspector has unlocked for examining, the red indication of the indicator (or protruded) cannot be changed into the green indication (or indented) by the inspector. When a user pushes a switch to change the indication from red (protruded) to green (indented), the user cannot change the indicator from green (indented) to red (protruded), either; hence, the indicator can explicitly display the state of the lock.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A two-way opened strap lock with an indication, comprising a housing, an end of which is connected with a strap, an interior of which is provided with dials and a tumbler, an end of which is disposed with a mouth, and one side of which is disposed with an indication hole, with the tumbler providing for an insertion with a key; a cover, which is locked with the housing, one end of which is connected with the strap, and a second end of which is disposed with protruded members being inserted into the mouth of the housing; and an indicator assembly, which is emplaced in the housing, and includes a switch and an indicator, with the indicator being pushed to a second position from a first position relative to the housing by the tumbler, and the switch switching the indicator at the second position back to the first position, such that when the mouth of the housing is covered by the cover, the indicator position is not able to be changed by an ambient object;

wherein an interior of the housing is provided with a knob and clamps, the knob is connected with the tumbler, a U-shape slot at an end of the knob provides for emplacing the clamps, and a notch at the other end of the knob allows the indicator to be extended into; when turning the tumbler to drive the knob to rotate, the U-shape slot of the knob facing toward the clamps, the notch then pushing the indicator to the second position from the first position, with the first and second positions being displayed from the indication hole of the housing.

2. A two-way opened strap lock with an indication, comprising a housing, an end of which is connected with a strap, an interior of which is provided with dials and a tumbler, an end of which is disposed with a mouth, with the tumbler providing for an insertion with a key; a cover, which is locked with the housing, an end of which is connected with the strap, and the other end of which is disposed with protruded members being inserted into the mouth of the housing; and an indicator assembly, which is emplaced in the housing, and includes a switch and an indicator, with the indicator being pushed to a second position from a first position relative to the housing by the tumbler, and the switch switching the indicator at the second position back to the first position, such that when the mouth of the housing is covered by the cover, the indicator position is not able to be changed by an ambient object;

wherein an interior of the housing is provided with a knob and clamps, the knob is connected with the tumbler, a U-shape slot at one end portion of the knob provides for emplacing the clamps, and a notch at a second end portion of the knob allows the indicator to be extended into; when turning the tumbler to drive the knob to rotate, the U-shape slot of the knob facing toward the clamps, the notch then pushing the indicator to the second position of protrusion from the first position of indentation, of the housing.

3. The two-way opened strap lock with an indicator, according to claim 2, wherein the switch and the indicator are provided with inverted hooks, with two inverted hooks being latched together, a center of the switch is provided with a spring leaf, and a center of the indicator is provide with a spring; using a key to turn the tumbler to drive the indicator to protrude out of the housing, allowing the indicator to be changed from the first position of indentation to the second position of protrusion, of the housing.

* * * * *